US006269799B1

(12) United States Patent
Watanabe et al.

(10) Patent No.: US 6,269,799 B1
(45) Date of Patent: Aug. 7, 2001

(54) OUTBOARD MOTOR FUEL SUPPLY SYSTEM

(75) Inventors: Hitoshi Watanabe; Masaki Okazaki; Takahide Watanabe, all of Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/384,698

(22) Filed: Aug. 26, 1999

(30) Foreign Application Priority Data

Aug. 26, 1998 (JP) ..... 10-239658

(51) Int. Cl.[7] ..... F02M 37/04; F02B 13/00
(52) U.S. Cl. ..... 123/509; 123/579
(58) Field of Search ..... 123/508, 509, 123/516, 579, 580, 495, 195 P; 440/88, 89

(56) References Cited

U.S. PATENT DOCUMENTS 5,425,336 * 6/1995 Nakayama ..... 123/198 R
5,450,831 9/1995 Fukuoka ..... 123/509
5,501,202 3/1996 Watanabe ..... 123/572
5,797,378 * 8/1998 Kato ..... 123/516

* cited by examiner

*Primary Examiner*—Henry C. Yuen
*Assistant Examiner*—Mahmoud Gimie
(74) *Attorney, Agent, or Firm*—Knobbe, Martens, Olson & Bear, LLP

(57) ABSTRACT

A fuel supply system for use with an engine having four vertically-arranged cylinders and multiple charge formers prevents air or vapor pockets from accumulating within the fuel pump or fuel lines. A pair of fuel pumps are mounted vertically one above the other. A fuel inlet port of each pump is formed at the lower-most portion of the pump. A fuel discharge port is formed at the upper-most portion of each port. A conduit attached to the top fuel pump's discharge port supplies fuel to an uppermost and lowermost carburetor. A conduit from the lowermost fuel pump supplies fuel to the middle two carburetors. The uppermost carburetor's fuel inlet port is positioned vertically higher than the top fuel pump's discharge port. The second carburetor's fuel inlet port is positioned vertically higher than the second fuel pump's discharge port. Air or vapor pockets within the fuel lines naturally migrates through the fuel pump and through the fuel conduits into the carburetors without becoming trapped in the fuel supply system.

19 Claims, 6 Drawing Sheets

OUTBOARD MOTOR FUEL SUPPLY SYSTEM

BACKGROUND OF THE INVENTION

1. Field of the Invention

This invention relates to a fuel supply system for an engine, and more particularly to an improved fuel supply system for an engine having multiple charge formers.

2. Description of the Related Art

Many internal combustion engines are provided with a plurality of charge formers. With such an arrangement, it is desirable to ensure that the fuel supply system delivers fuel uniformly and equally to all of the charge formers. Although this is generally not a problem, with certain types of applications for internal combustion engines, it can become a problem.

For example, with some applications for internal combustion engines, the charge formers are disposed so that they are positioned vertically above each other. This is typical, for example, in outboard motor practice. In outboard motors, the engine is disposed so that its output shaft rotates about a vertically extending axis. As a result, the individual cylinders extend generally horizontally and are arranged in a vertically spaced relationship. The charge formers, therefore, adopt a similar attitude and disposition.

Fuel supply systems for engines with vertically-arranged charge formers frequently include a single conduit or manifold that extends from the fuel pump to all charge formers. The conduit may be configured in such a way that it forms areas where fuel or vapor can become trapped. Additionally, the fuel pump itself may be configured in such a way that it forms areas where fuel vapor can be trapped. If a fuel vapor pocket forms, then the charge formers downstream of the vapor pocket will not receive fuel, or at least not receive a desired amount of fuel, thereby affecting proper engine operation.

In an attempt to alleviate these problems, it has been proposed to provide the fuel pump at a lower location than the charge formers. Also, the fuel pump may be provided with a plurality of fuel outlets and conduits that feed respective carburetors of the system. With this type of arrangement, however, the fuel pump is normally positioned below the lowest carburetor. In this position, the relatively high head between the fuel pump and the highest carburetor restricts the fuel pump's ability to deliver fuel. Also, vapor venting is not assured. Furthermore, a fuel pump mounted below the lowest carburetor may not be capable of being powered by an engine camshaft.

Accordingly, a need exists for a fuel supply system for an engine having multiple charge formers, wherein the system ensures against vapor blockage in fuel supply lines. There is a further need for a fuel system having a fuel pump which is powered by a camshaft, the fuel pump being arranged to prevent vapor interference with fuel flow.

SUMMARY OF THE INVENTION

One aspect of the present invention involves an internal combustion engine having at least one variable volume combustion chamber. The combustion chamber is defined by at least a pair of components that move relative to each other. A charge former supplies a fuel/air charge to the combustion chamber, and a fuel supply system provides fuel to the charge former. The fuel supply system includes a fuel pump having a discharge port communicating through a conduit with the charge former. The discharge port is positioned at an uppermost portion of the fuel pump, and a discharge check valve is positioned adjacent the discharge port. This orientation of the fuel pump inhibits vapor from becoming trapped within the fuel pump.

Further aspects, features and advantages of the present invention will become apparent from the detailed description of the preferred embodiment which follows.

BRIEF DESCRIPTION OF THE DRAWINGS

The above-mentioned and other features of the invention will now be described with reference to the drawings of a preferred embodiment of the present engine and fuel supply system. The illustrated embodiment is intended to illustrate but not limit the invention. The drawings contain the following figures.

DETAILED DESCRIPTION OF THE PREFERRED EMBODIMENT

Figure 1:
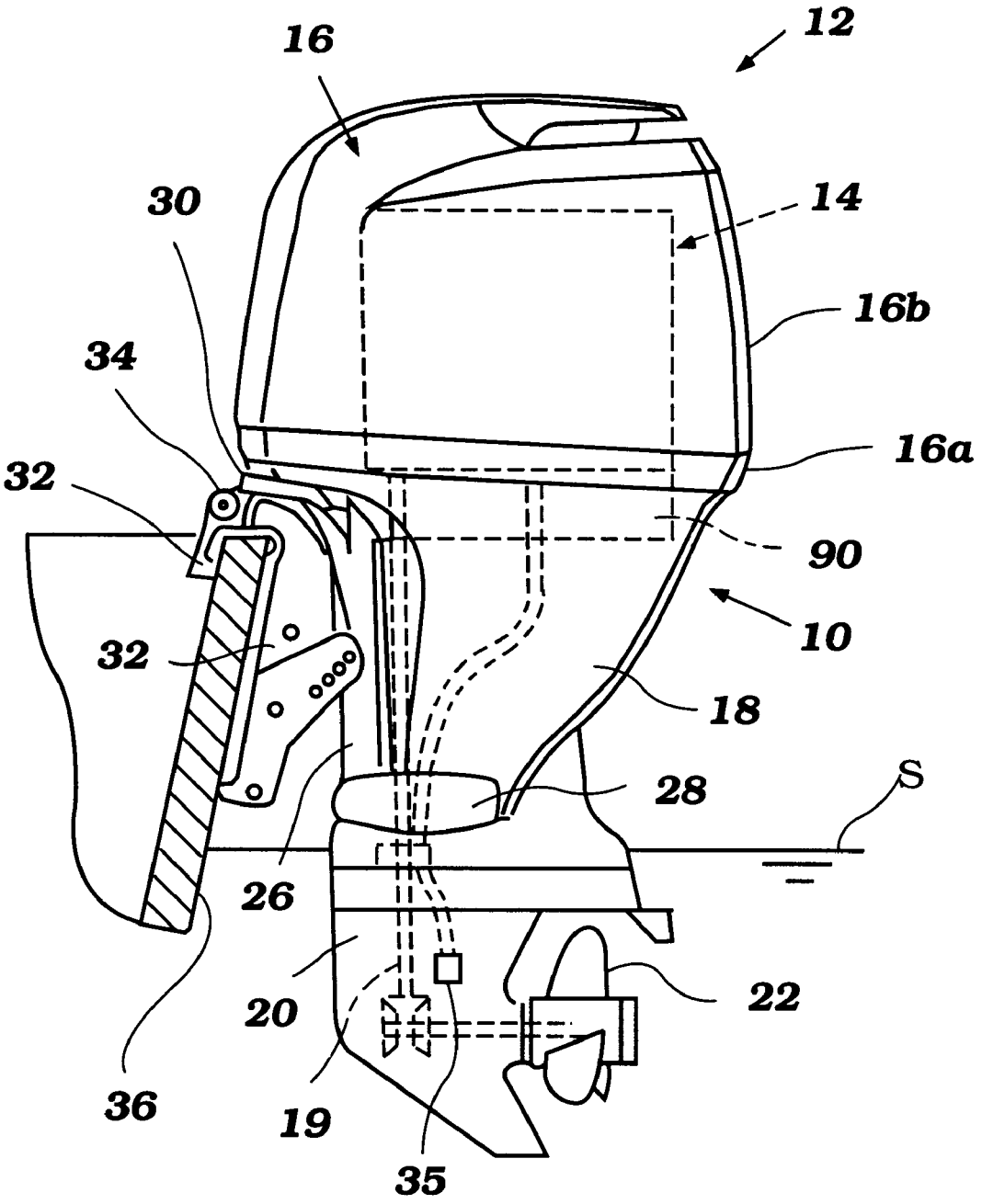
FIG. 1 is a side elevational view of an outboard motor in which the present fuel supply system can be employed.

FIG. 1 illustrates an outboard drive 10 which incorporates a fuel supply system configured in accordance with the preferred embodiment of the present invention. Because the present fuel supply system has particular utility with an outboard motor, the fuel supply system is described below in connection with the outboard motor. However, the description of the invention in conjunction with the illustrated outboard motor is merely exemplary.

The outboard motor 10 has a power head 12 which includes an internal combustion engine 14. A protective cowling assembly 16 surrounds the engine 14. The cowling assembly 16 includes a lower tray 16*a* and a main cowling member 16*b*.

Figure 2:
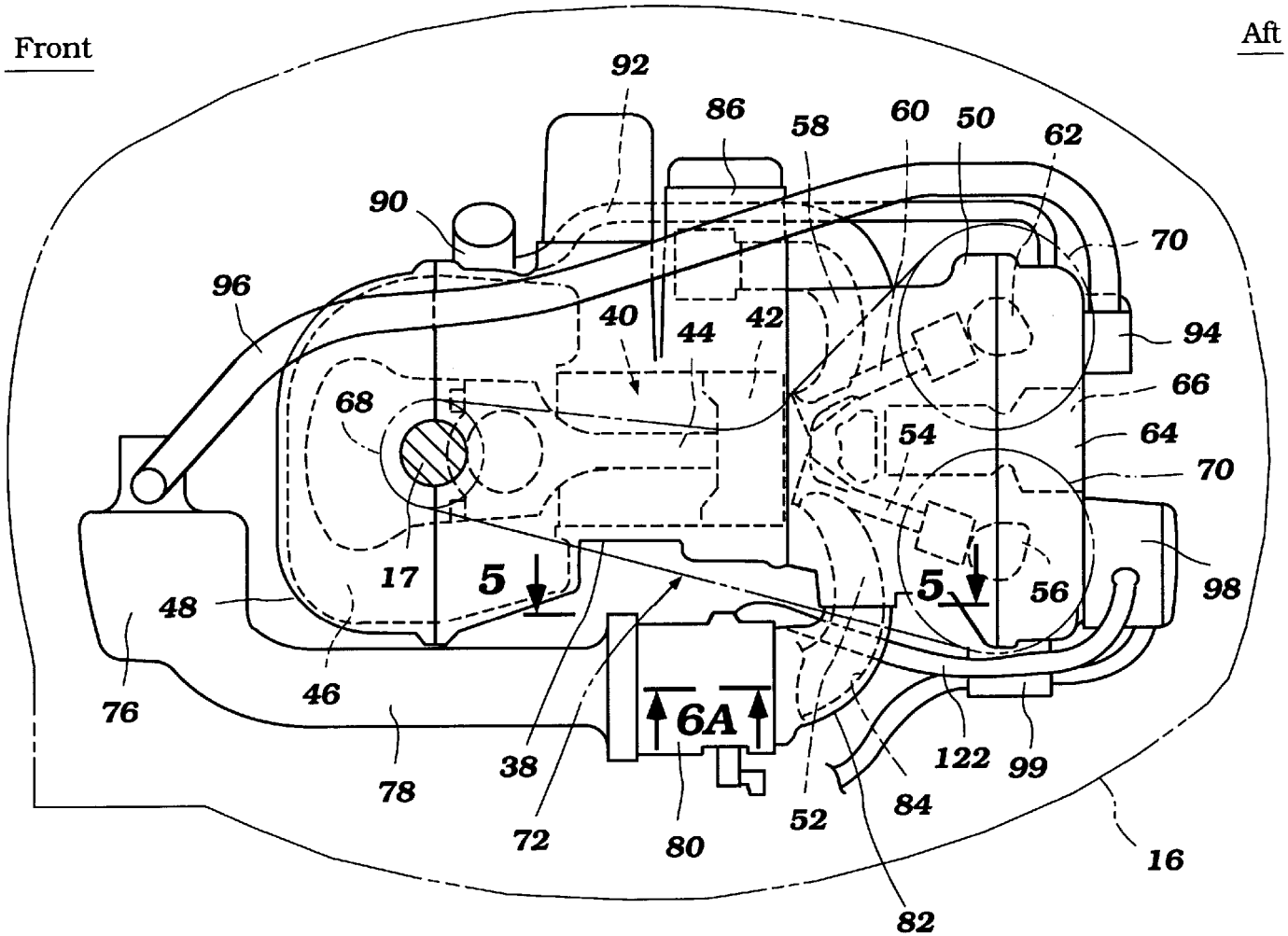
FIG. 2 is a top view of the outboard motor of FIG. 1, illustrating the engine and the fuel supply system, which is configured in accordance with a preferred embodiment of the present invention, with the cowling and selected components of the engine shown in phantom.

As is typical with outboard motor practice, the engine 14 is supported within the power head 12 so that its output shaft 17 (i.e., a crankshaft as illustrated in FIG. 2) rotates about a vertical axis. The crankshaft 17 is coupled to a drive shaft 19 that depends through and is journalled within a drive shaft housing 18.

The drive shaft housing 18 extends downward from the cowling 16 and terminates in a lower unit 20. The drive shaft 19 extends into the lower unit 20 to drive a transmission housed within the lower unit 20. The transmission selectively establishes a driving condition of a propulsion device 22. In the illustrated embodiment, the propulsion device 22 is a propeller. The transmission desirably is a forward/neutral/reverse-type transmission so as to drive the watercraft in any of these operational states.

A steering shaft extends through a steering bracket 24 and rotates about a vertically extending axis. The steering bracket 24 is affixed to the drive shaft housing 18 by upper and lower brackets 26, 28. Steering movement occurs about a generally vertical steering axis which extends through the steering shaft. A steering arm 30 is connected to an upper end of the steering shaft 26 and extends in a forward direction for manual steering of the outboard motor 10, as known in the art.

The swivel bracket 26 also is pivotally connected to a clamping bracket 32 by a pin 34. The clamping bracket 32, in turn, includes a transmission adapted to attach to a transom 36 of an associated watercraft 37. The clamping bracket 32 is arranged on the transom 36 at a location which supports the outboard motor 10 in a generally upright position and at a location where the blades of the propeller 22 lie at least partially beneath the surface level S of the body of water in which the watercraft 37 is operated.

The conventional coupling between the swivel bracket 26 and the clamping bracket 32 permits adjustment of the trim position of the outboard motor 10, as well as allows the outboard motor 10 to be tilted up for transportation or storage. For this purpose, a conventional tilt and trim cylinder assembly desirably operates between the clamping bracket 32 and the swivel bracket 26. This conventional mounting thus permits the outboard motor 10 to move within a normal or designed range of positions relative to the transom between a generally upright position (or slightly tilted away from the transom) to a full tilt-up position. This results in about an 80 degree range of movement when installed on the transom (i.e., between normal operating positions).

The drive shaft 19 drives a water pump which preferably is disposed at the lower end of the drive shaft housing 18. The pump draws water through an inlet port 35 and delivers the water to the engine 14. At least a portion of the cooling water is discharged from the outboard motor 10 through an exhaust system (described later) with the exhaust gasses from the engine in order to cool and silence the exhaust gasses, as known in the art.

The construction of the outboard motor 10 as thus far described is considered to be conventional, and for that reason further details of the construction are not believed necessary to permit those skilled in the art to understand and practice the invention.

In order to facilitate the description of the present invention, the terms "front" and "rear" or "aft" are used to indicate the relative sides of the components of the engine and the fuel supply system. As used herein, "front" refers to the side closest to the transom 36, while "rear" or "aft" refer to the side farthest from the transom 36.

Figure 3:
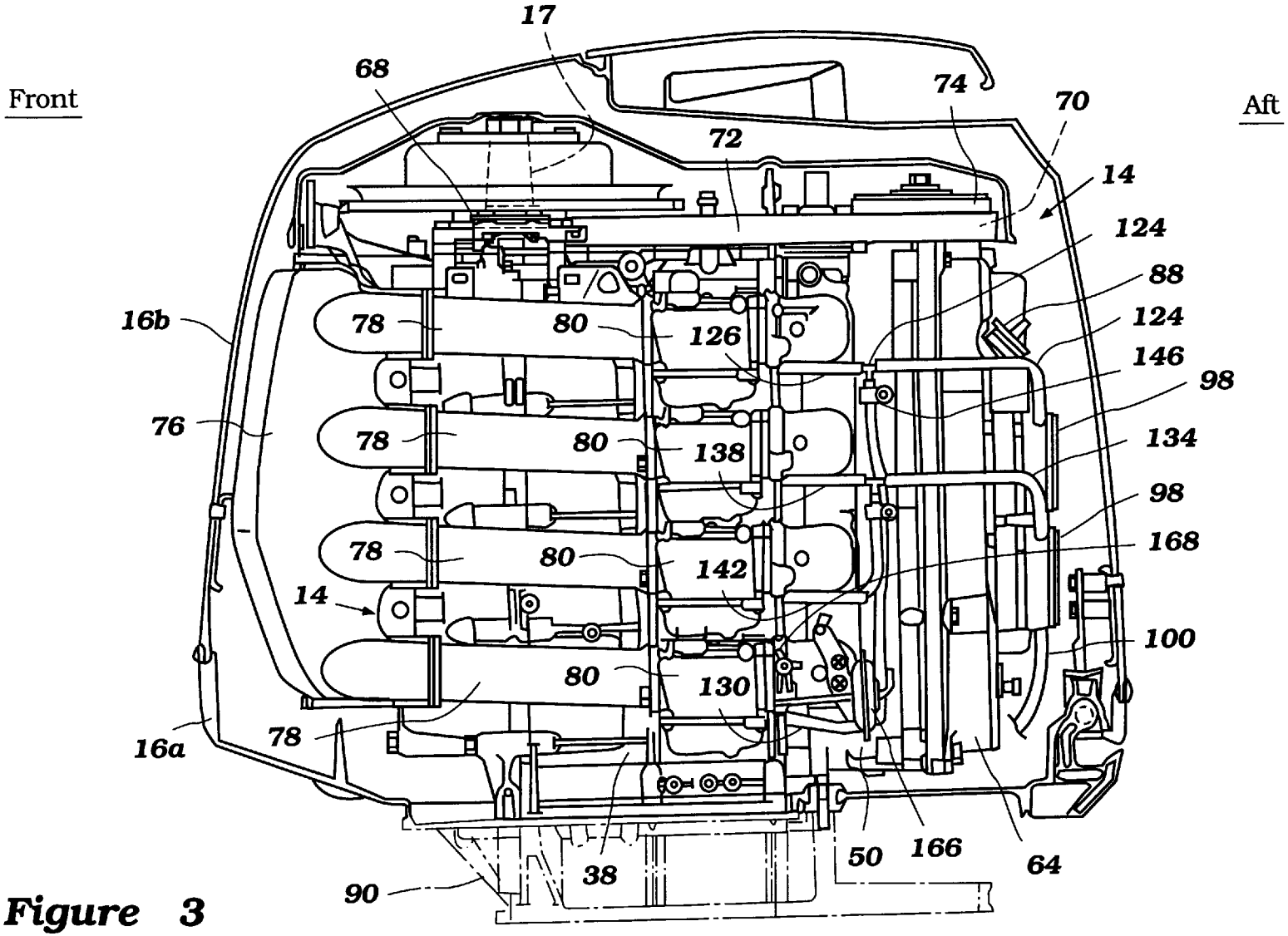
FIG. 3 is a side view of the outboard motor of FIG. 1 with the cowling shown in section.

With reference to FIGS. 2 and 3, the engine 14 preferably operates on a four-cycle combustion principle and includes a cylinder block 38 having four cylinders 40 formed therein in a vertically spaced arrangement. FIG. 2 illustrates a top cylinder 40 in phantom lines. A piston 42 is positioned within the cylinder 40 and is adapted for reciprocating movement therein. The piston 42 is connected to a first end of a connecting rod 44. A second end of the rod 44 is rotatably connected to a throw of the crankshaft 17. The crankshaft 17 rotates about a substantially vertical axis and is enclosed within a crankcase 46, which in the illustrated embodiment is formed between an aft end of the cylinder block 38 and a crankcase member 48.

A cylinder head 50 is attached to the cylinder block 38. A combustion chamber is formed by the cylinder head 50, and corresponding cylinder 40 and piston 42. An intake port 52 is formed through the cylinder head 50, providing a passageway for an air/fuel charge to enter the combustion chamber. An intake valve 54 is supported by the cylinder head 50 and is adapted to regulate flow through the intake port 52 into the combustion chamber. An intake valve camshaft 56 is journalled within the cylinder head 50. The intake valve camshaft 56 actuates the intake valve 54 in a reciprocating manner as known in the art. Each cylinder of the engine has associated with it an intake port and intake valve which is actuated by the camshaft.

An exhaust port 58 is also formed in the cylinder head 50. The exhaust port 58 provides a passage for exhausts product to exit the combustion chamber. An exhaust valve 60 is supported by the cylinder head 50 and regulates flow through the exhaust port 58. An exhaust valve camshaft 62 is journalled within the cylinder head 50 and is adapted to actuate the exhaust valve 60 in a reciprocating manner similar to that of the intake valve and intake valve camshaft. Again, each cylinder of the engine has associated with it an exhaust port and an exhaust valve which is actuated by the corresponding camshaft. While the illustrated embodiment employs one intake valve and one exhaust valve per cylinder, other numbers of exhaust and intake valves can also be used.

A cylinder cover 64 is fit over the cylinder head 50 and encloses a camshaft chamber 66 therein. The camshafts 56, 62 and valves 54, 60 are enclosed within the camshaft chamber 66.

A drive pulley 68 is connected to the crankshaft 17. A pair of camshaft driven pulleys 70 are also provided and are connected to respective camshafts 56, 62. A belt 72 extends around the pulleys 68, 70. In this manner, the drive pulley 68 drives the camshaft pulleys 70. To ensure proper valve timing, the camshaft drive pulleys are preferably twice the diameter of the crankshaft drive pulley.

As best shown in FIG. 3, a flywheel 74 is positioned above the crankshaft drive pulley 68 and is adapted to rotate with the crankshaft 17. It is to be understood that although the flywheel 74 and the pulleys 68, 70 are illustrated as disposed at the top of the engine, these components can be appropriately rearranged. For example, the drive shaft and flywheel may be positioned at the bottom of the engine.

An air inlet device 76 is positioned near the front of the engine 14 and is adapted to intake air from within the cowling 16. As best shown in FIG. 3, the air inlet device 76 splits into four intake pipes 78, each intake pipe 78 being adapted to deliver an air charge to a corresponding combustion chamber. A carburetor 80 communicates with an each intake pipe opposite of the intake device 76 and is adapted to introduce a fuel charge into the air charge. Each of the carburetors 80 are connected to an intake manifold 82. The intake manifold 82 includes a plurality of passages 84. The manifold passages 84 communicate with the intake ports 52 formed in the cylinder head 50. For each cylinder, the air/fuel charge is delivered from the corresponding intake passage 84 to the intake port 52, as regulated by the intake valve 54, to the corresponding combustion chamber. After combustion, the exhaust products flow through the exhaust valve 60, out of the exhaust port 58, and to an exhaust manifold 86.

Figure 4A:
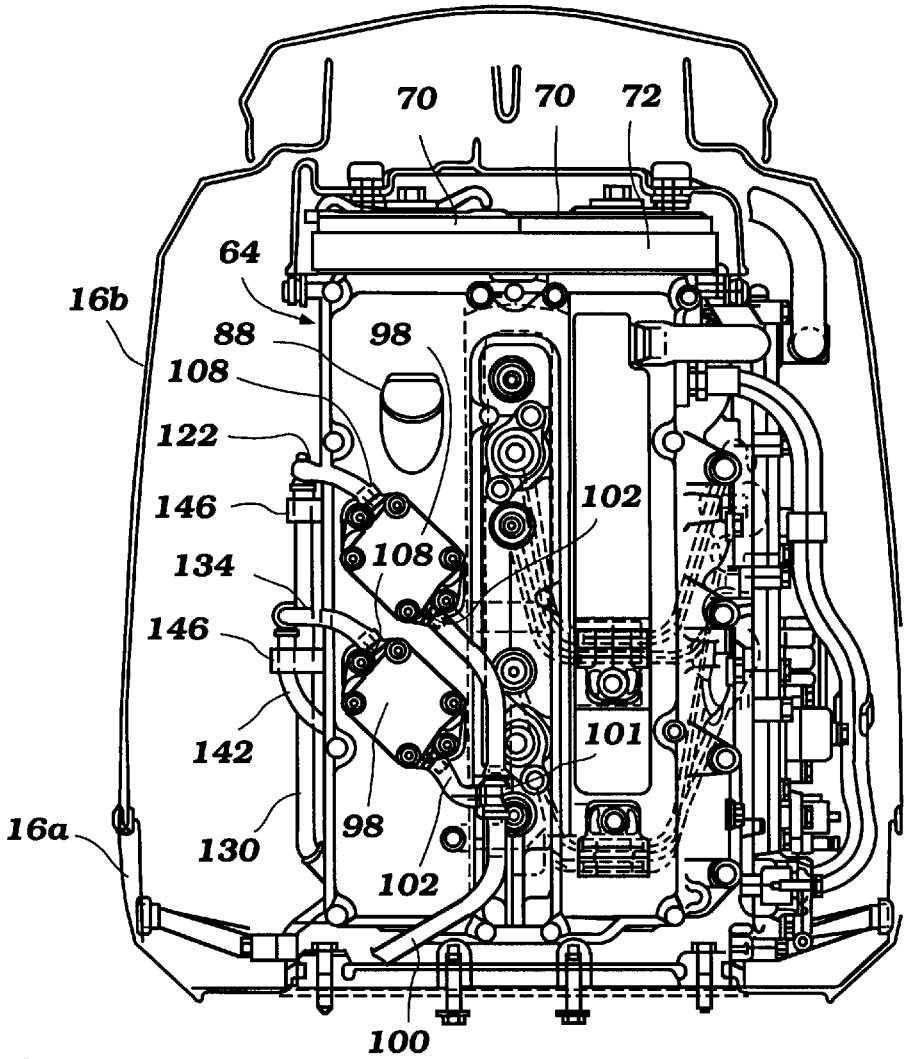
FIG. 4A is a rear end view of the power head of the outboard motor of FIG. 1 with the cowling shown in section.

With reference also to FIG. 4A, an oil fill port 88 is located on the cylinder head cover 64. The fill port 88 extends through the cylinder head cover 64, allowing addition of lubricant into the camshaft chamber 66. Oil galleries are formed in the cylinder block 38 and are adapted to communicate lubricant from the camshaft chamber 66 to various engine components, such as the pistons 42, crankshaft 17 and connecting rods 44. An oil pan (not shown) desirably collects oil that has circulated through the galleries and the crankcase 66. In one mode, the oil pan can be mounted to an underside of an exhaust guide 90 (which is shown in FIG. 3).

As seen in FIG. 2, an oil pump 90 is provided for transferring oil from the oil pan to the camshaft chamber 66 and for recirculation through the engine. An oil conduit 92 communicates lubricant from the oil pump 90 to the camshaft chamber 66.

A blow-by gas vapor separator 94 is mounted on the cylinder head cover 64 and communicates with the camshaft chamber 66. A return pipe 96 extends from the vapor separator 94 to the air inlet device 76. Blow-by gasses separated from oil within the vapor separator 94 are delivered through the return pipe to the air inlet device 76 for eventual delivery to one of the combustion chambers for burning.

A pair of fuel pumps 98 are mounted on the cylinder head cover 64, one above the other. A fuel supply conduit 100 extends from a source of fuel, such as a fuel tank, through a fuel filter 99 (FIG. 2), to a T-fitting 101 (FIG. 4). Upper and lower supply conduits extend from the T-fitting 101 to inlet ports 102 of the respective upper and lower fuel pumps 98. The T-fitting 101 is preferably positioned vertically lower than the inlet port 102 of the lower fuel pump 98. Thus, the fuel supply conduits preferably follow a generally upwardly-directed path to the fuel pumps 98.

Figure 4B:
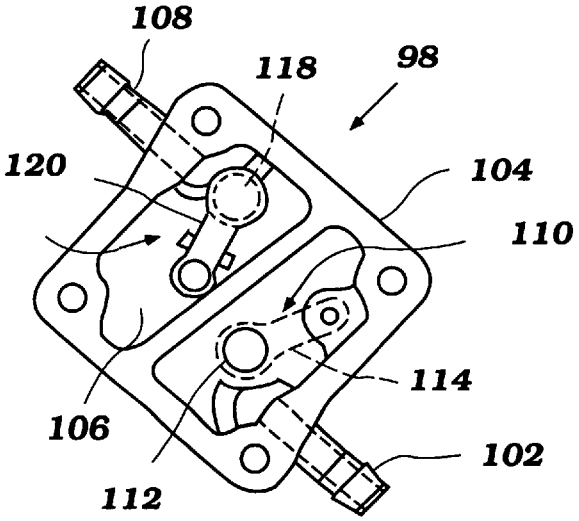
FIG. 4B is an enlarged, sectional view of a fuel pump of the fuel supply system shown in FIGS. 2 and 4A.

As shown in FIG. 4B, each fuel pump 98 comprises a housing 104 enclosing a pump chamber 106. The inlet port 102 is provided at a lower portion of the housing 104. The inlet port 102 is preferably oriented to extend at least partially downward. A discharge port 108 is provided at an upper portion of each fuel pump 98. The discharge port 108 is preferably oriented to extend at least partially upward.

An inlet valve 110 is positioned adjacent the inlet port 102. The valve 110 includes a valve seat 112 that is positioned at least partially to the side of the inlet port 102. A valve element 114 cooperates with the valve seat 112 and is biased to a closed position. The valve element 114 is also arranged to provide one-way flow through the valve 110 in a direction into, but not out of, the pump chamber 106.

A discharge valve 116 valve is positioned adjacent the discharge port 108 in an upper portion of the fuel pump 98. The discharge valve 116 includes a valve seat 118 that is positioned immediately adjacent to, but at least partially to the side of, the discharge port 108. The discharge valve 116 is preferably a one-way valve adapted to allow flow out of, but not into, the pump chamber 106. A valve element 120 cooperates with the valve seat 118 and is arranged to permit the valve to function in this manner. The valve element 120 desirably is biased toward a closed position.

A diaphragm (not shown) encloses the pump chamber 106. The diaphragm preferably is actuated by with the intake valve camshaft 56 to alternatively pressurize and depressurize the pump chamber 106 in order to effect flow therethrough. Although the illustrated fuel pumps 98 are powered by rotation of the intake valve camshaft 56, it is to be understood that fuel pumps 98 having various operating principles may appropriately be used in accordance with the present invention.

Figure 5:
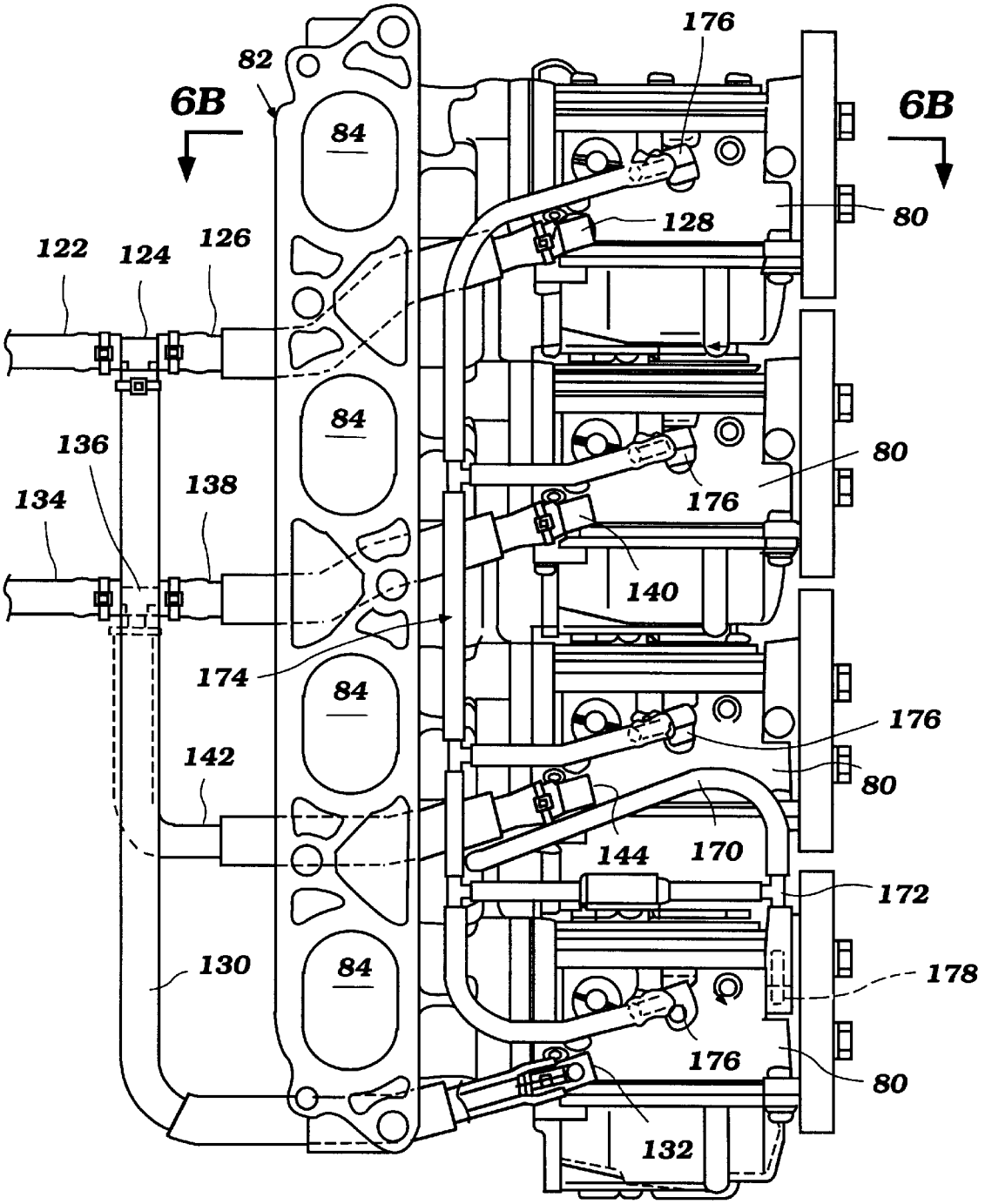
FIG. 5 is a view of a bank of carburetors and a portion of the fuel supply system of FIG. 2 as viewed in the direction of line 5—5 of FIG. 2, with the fuel delivery lines unattached to the engine.

A conduit 122 is attached to the top fuel pump discharge port 108 and extends around the side of the engine to a T-fitting 124, as illustrated in FIG. 5. The T-fitting 124 is positioned vertically higher than the discharge port 108. From the T-fitting 124, a first delivery conduit 126 extends to an uppermost carburetor fuel inlet 128. The uppermost carburetor fuel inlet 128 is preferably positioned vertically higher than the T-fitting 124. A second delivery conduit 130 extends from the T-fitting 124 to a lowermost carburetor fuel inlet port 132. The conduits 122, 126 from the discharge port 108 to the uppermost carburetor fuel inlet port 128 follow a generally upwardly-directed path. Although portions of the path may extend substantially horizontally, there are preferably no downwardly-extending sections within these lines.

The discharge port 108 of the lower fuel pump 98 also communicates with a conduit 134 which extends around the engine to a T-fitting 136. A third delivery conduit 138 extends from the T-fitting 136 to a second carburetor fuel inlet 140. The second carburetor 80 is preferably positioned immediately below the uppermost carburetor 80. The second carburetor fuel inlet 140 is preferably positioned vertically above the T-fitting 136, which is positioned vertically above the second fuel pump discharge port 108. As above, the conduits 134, 138 follow a generally upwardly-directed path from the lower pump discharge port 108 to the second carburetor fuel inlet 140. A fourth delivery conduit 142 extends from the T-fitting 136 to a third carburetor fuel inlet port 144. The third carburetor 80 is preferably positioned below the second carburetor 80 and above the lowermost carburetor 80.

As best seen in FIG. 4A, a bracket 146 secures each T-fitting 124, 136 onto the cylinder head 50. Each bracket 146 desirably is attached to a lower branch of the respective T-fitting 124, 136 and supports a portion of corresponding delivery conduit 130, 142 attached to the lower branch of the fitting.

The above-described arrangement of fuel pumps 98 and conduits provides advantages in fuel delivery. When air or fuel vapor becomes present in the fuel supply system, the vapor will naturally tend to migrate upwardly with the conduit paths. Vapor that flows into the fuel pumps 98 will naturally move to the top of the fuel pumps 98. Because the discharge port 108 is oriented towards the top of the fuel pump 98 and because of the orientation of the discharge pump port 108, the vapor will not accumulate to form a vapor pocket, but will instead naturally migrate out of the pump 98. Thus, operation of the pump 98 will not be significantly interrupted by the presence of a vapor pocket within the pump 98.

After the vapor has passed through the pump into the delivery conduits, the vapor will continue to naturally migrate to the uppermost portion of the conduits. In the case of the upper fuel pump 98, the first conduit 126 proceeds generally upwardly to the uppermost carburetor fuel inlet port 128. Accordingly, vapor will naturally migrate to the carburetor inlet port 128, enter the carburetor's fuel bowl, and be vented in a known manner. In the case of the lower fuel pump 98, an air pocket within the associated fuel delivery conduits will naturally migrate through the third conduit 138 to the second carburetor fuel inlet port 140, where it enters the carburetor fuel bowl and is vented. In this manner, air or vapor that may be found within the fuel supply system will not create blockages within the system and will not significantly interrupt the fuel supply to the carburetors 80.

Figure 6A:
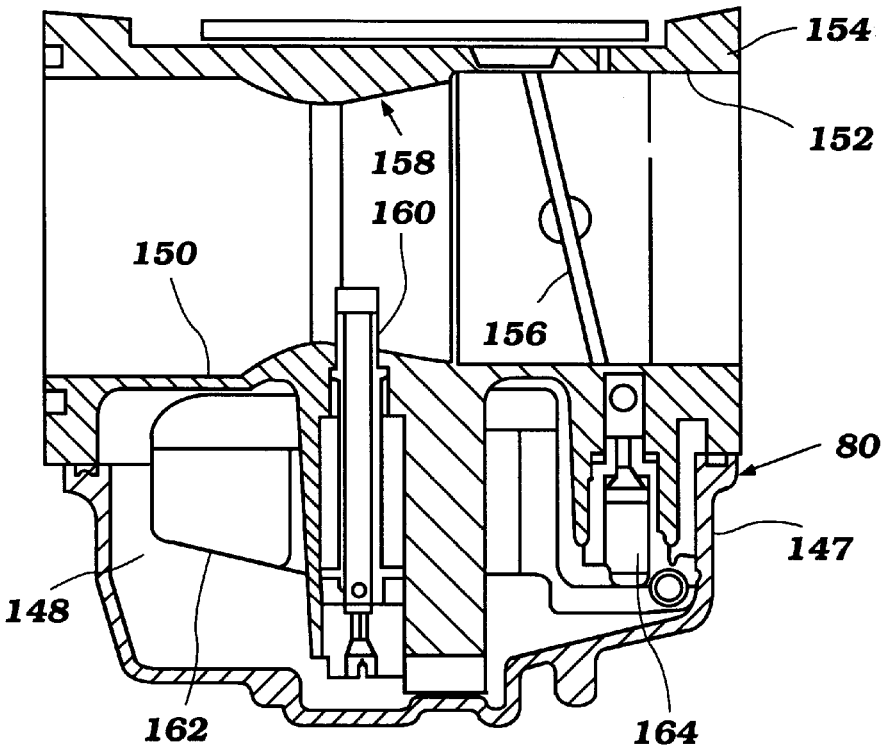
FIG. 6A is a side cross-sectional view of one of the carburetors of the engine taken along lines 6A—6A of FIG. 2.
Figure 6B:
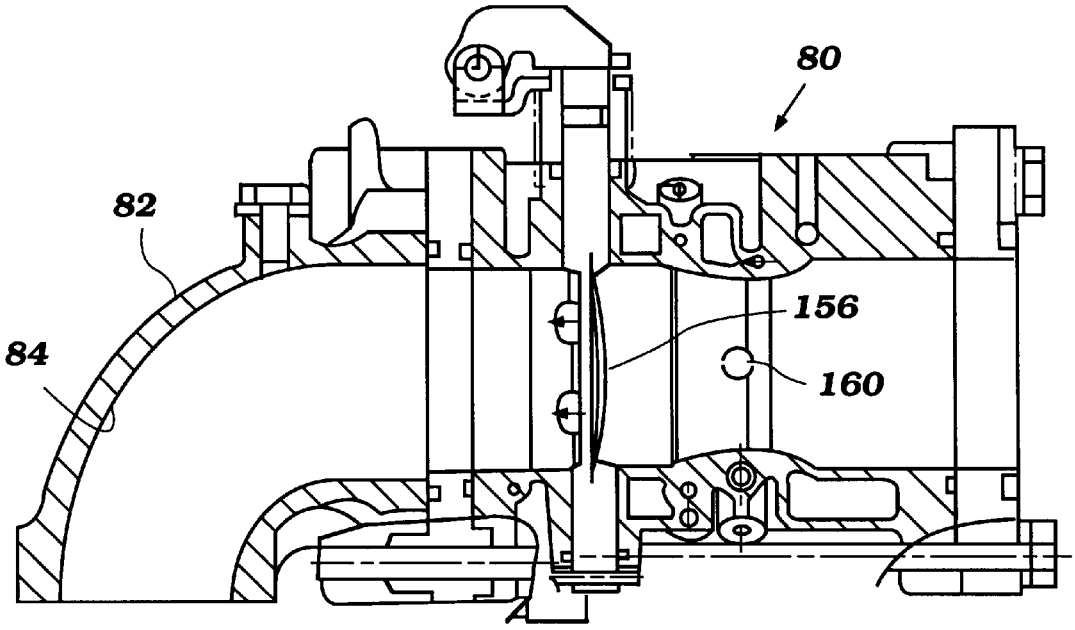
FIG. 6B is a cross-sectional view of one of the carburetors taken along lines 6B—6B of FIG. 5.

With reference to FIGS. 6A and 6B, a cross-sectional view of one of the carburetors 80 is shown. A fuel bowl 147 defines a chamber 148 within the carburetor 80 in which fuel is stored. A wall 150 separates the fuel bowl chamber 148 from a throttle passage 152. The throttle passage 152 is formed within a throttle body 154. Air flowing through the intake passage 152 is regulated by a throttle valve 156. A venturi 158 is formed downstream of the throttle valve 156 to lower the air pressure within the intake passage 152. A suction port 160 extends into the venturi section 158 and provides a passageway between the intake pipe and the fuel bowl 148. As air flows through the venturi 158, fuel from the fuel bowl 148 is drawn through the suction port 160 and into the intake passage 160, as known in the art.

A float 162 within the fuel bowl 148 actuates a nee valve 164 when the fuel level drops below a predetermined level. Actuation of the needle valve 164 enables fuel from the carburetor fuel inlet port to flow into the fuel bowl 148, filling the fuel bowl to the predetermined level.

The carburetor preferably includes a pressure relief valve (not shown). Air or vapor that flows into the carburetor from the fuel supply system accumulates within the carburetor. When pressure within the carburetor exceeds a defined limit, the vapor is vented from the carburetor into the intake pipe through the pressure relief valve.

A fuel increasing mechanism is also employed with the carburetors 80 of the engine 14, as best appreciated from FIGS. 3 and 5. In the illustrated embodiment, the fuel increasing mechanism includes a first dash-pot 166 linked to a throttle linkage 168. The throttle linkage 168 actuates the throttle valves 156 of the carburetors 80 so as to move the valves 156 generally in unison. The linkage 168 also actuates the dash-pot 166, as described below.

The dash pot 166 includes an air chamber that communicates with each of the fuel bowl chambers 148 through a plurality of air lines. In the illustrated embodiment, as best seen in FIG. 5, a first delivery line 170 extends from the dash pot 166 to a T-fitting 172 located on the opposite side of the carburetor bank. One branch of the T-fitting 172 communicates with an air line manifold 174. The manifold 174 is formed by a plurality of fittings and conduits. Some of the conduits extend between the fittings, and other conduits connect the fittings to air ports 176 on the carburetor bodies 154 that communicate with the corresponding fuel bowl chambers 148.

The other side of the T-fitting 172 is connected to a second dash pot 178. The second dash pot 178 is also linked to the throttle valves 156 and is actuated by movement of the throttle valves 156 (i.e., by the corresponding linkage, levers or shafts).

Upon rapid acceleration or deceleration, the throttle valves 156 are opened or closed rapidly. The dash pot produces an air pulse with such quick movement. In the illustrated embodiment, the first dash pot 166 produces such a pulse upon rapid opening of the throttle valves 156, while the second dash pot 168 produces such a pulse upon rapid closing of the throttle valves 156. These pulses are delivered to the fuel bowl chambers 148 of the carburetors 80 through the air line manifold 174. The pulses of air increase the pressure within the fuel bowl chamber 148 and cause an increased amount of fuel to squirt through the suction port 160. In this manner, an enriched air/fuel charge is delivered to the combustion chambers during periods of rapid acceleration and deceleration in order to improve engine performance and operation.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. An internal combustion engine having a plurality of variable volume combustion chambers having horizontal axes and oriented so that their axes are arranged above one another, each of the combustion chambers being defined by at least a pair of components that move relative to each other, a plurality of charge formers, each charge former communicating with a corresponding combustion chamber to supply a fuel/air charge to the respective combustion chamber, the charge formers arranged vertically relative to each other, and a fuel supply system connected to the charge formers to deliver fuel to the charge formers, the fuel supply system including a fuel pump having a discharge port communicating through a conduit system with the charge formers, the discharge port being positioned at an uppermost portion of the fuel pump so that the vapor within the pump will migrate toward and through the discharge port into the conduit system, and a discharge check valve positioned adjacent the discharge port, the discharge port being positioned below a fuel inlet port of the uppermost charge former, the conduit system defining a generally upwardly-directed path from the discharge port to the uppermost charge former fuel inlet port, the conduit system adapted so that, at any point within the conduit system, a generally upwardly directed path toward a fuel inlet port of one of the charge formers is defined within the conduit system so that vapors can be smoothly and easily vented from the conduit system to the charge formers.

2. The engine of claim 1, wherein the fuel pump is powered by a cam shaft of the engine.

3. The engine of claim 1, wherein the discharge port is positioned vertically lower than a fuel inlet port of the charge former.

4. The engine of claim 3, wherein the engine includes an output shaft, and the output shaft is adapted to rotate about a substantially vertical axis.

5. The engine of claim 4, including a second fuel pump, the second fuel pump having a second discharge port positioned at an uppermost portion of the second fuel pump, and the second fuel pump is oriented vertically below the first fuel pump, and the second discharge port is positioned vertically below a second charge former fuel inlet port.

6. The engine of claim 5, including four combustion chambers arranged vertically relative to each other, each communicating with a corresponding charge former, and the first fuel pump communicates with the uppermost charge former and a lowermost charge former, and the second fuel pump communicates with a pair of middle charge formers.

7. The engine of claim 1, wherein the charge former includes a fuel bowl having an inlet, and the fuel pump discharge port is positioned vertically below the fuel bowl inlet.

8. The engine of claim 1, wherein the discharge port is at least partially upwardly-directed.

9. The engine of claim 8, wherein the conduit between the discharge port and the fuel inlet port follows a generally upwardly directed path.

10. The engine of claim 9, wherein the fuel pump includes an inlet port, the inlet port being positioned at a lowermost position of the fuel pump.

11. The engine of claim 10, including supply conduit communicating between a fuel source and the inlet port, and the supply conduit adjacent the fuel pump follows a generally upwardly directed path.

12. An internal combustion engine having at least two variable volume combustion chambers, the combustion chambers having horizontal axes that are arranged above one another, each of the combustion chambers being defined by at least a pair of components that move relative to each other, a plurality of charge formers for supplying fuel/air charges to corresponding combustion chambers, the charge formers also arranged above one another, and a fuel supply system for supplying fuel to the charge formers, the fuel supply system including a fuel pump having a discharge port communicating through a conduit system with the charge formers, the conduit system including means for evacuating vapor which may be in the conduit system so that vapor at any location within the conduit system travels along a path within the conduit system to a charge former for venting from the system without reentering the fuel pump.

13. The engine of claim 1, wherein the discharge port is positioned at an uppermost portion of the fuel pump and is at least partially vertically oriented.

14. The engine of claim 13, wherein the charge former includes a fuel reservoir having an inlet, and the discharge portion is positioned vertically lower than the inlet.

15. The engine of claim 14, wherein the conduit system comprises a first and a second conduit, the first conduit adapted to supply fuel to a first charge former and the second conduit adapted to supply fuel to a second charge former, and the first charge former is positioned vertically higher than the second charge former.

16. The engine of claim 15, including a second fuel pump positioned vertically lower than the first fuel pump, and the second fuel pump has a second discharge port that communicates with a third and a fourth conduit, the third conduit communicating with a third charge former and the fourth conduit communicating with a fourth charge former, and the third and fourth charge formers are positioned vertically higher than the second charge former and vertically lower than the first charge former.

17. An internal combustion engine having at least three variable volume combustion chambers having horizontal axes and being oriented so that their axes are arranged above one another, each of the combustion chambers being defined by at least a pair of components that move relative to each other, at least three charge formers also arranged above one another, each charge former communicating with a corresponding combustion chamber to supply a fuel/air charge to the combustion chamber, and a fuel supply system connected to the charge formers to deliver fuel to the charge formers, the fuel supply system including a first fuel pump having a discharge port communicating through a conduit with at least two of the charge formers, the discharge port being positioned at an uppermost portion of the fuel pump and being vertically lower than a fuel inlet port of an uppermost charge former and vertically above a fuel inlet port of a lower charge former, and a second fuel pump oriented vertically below the first fuel pump, the second fuel pump having a second discharge port positioned at an uppermost portion of the second fuel pump, the second discharge port being positioned vertically below a fuel inlet port of a middle charge former, the middle inlet port being vertically above the lower inlet port.

18. The engine of claim 17, wherein the engine includes an output shaft, and the output shaft is adapted to rotate about a substantially vertical axis.

19. The engine of claim 17, including four combustion chambers arranged vertically relative to each other, each communicating with a corresponding charge former, and the first fuel pump communicates with the uppermost charge former and a lowermost charge former, and the second fuel pump communicates with a pair of middle charge formers.

* * * * *